United States Patent [19]

Caylor

[11] 4,301,751

[45] Nov. 24, 1981

[54] TUFTING MACHINE FOR PRODUCING A VARIETY OF PILE FABRICS

[75] Inventor: L. Justin Caylor, Dalton, Ga.

[73] Assignee: Cherokee Sheet Metal Works, Inc., Dalton, Ga.

[21] Appl. No.: 85,790

[22] Filed: Oct. 17, 1979

[51] Int. Cl.[3] ..... D05C 15/00

[52] U.S. Cl. ..... 112/79 R

[58] Field of Search ..... 112/79 R, 79 A

[56] References Cited

U.S. PATENT DOCUMENTS

| | | | |
|---|---|---|---|
| 3,052,198 | 9/1962 | Whitney | 112/79 R |
| 3,100,467 | 8/1963 | Rice | 112/79 R |
| 3,138,126 | 6/1964 | Card | 112/79 R |
| 3,618,544 | 11/1971 | Watkins | 112/79 R |
| 3,626,878 | 12/1971 | Cobble | 112/79 R |
| 3,752,096 | 8/1973 | Mueller | 112/79 R |
| 4,029,029 | 6/1977 | Franks et al. | 112/79 R |

*Primary Examiner*—Ronald Feldbaum

*Attorney, Agent, or Firm*—James B. Middleton

[57] ABSTRACT

A tufting machine having opposed loopers for forming a variety of tufted fabrics is disclosed. A needle passes a yarn through a backing and a loop pile looper engages the yarn to form a loop. A cut pile looper is angled down so the bill of the cut pile looper is aligned with, adjacent to, and above the bill of the loop pile looper. In this position, the yarn can be tightened to cause the loop to transfer to the cut pile looper and be cut, or the yarn can be left slack so the loop will be released and remain as a loop. The backing fabric is angled up immediately past the needle, allowing space for operation of the cut pile looper, and assisting the loop to move out of the vicinity of the loopers. By variation of the cut pile looper, and variation of yarn feed by a conventional pattern mechanism, different heights of cut pile can be provided; by selectively tensioning the yarns, patterns of cut and loop pile can be provided; and, by varying yarn feed with a conventional pattern mechanism, different heights of loop pile can be provided.

18 Claims, 10 Drawing Figures

TUFTING MACHINE FOR PRODUCING A VARIETY OF PILE FABRICS

FIELD OF THE INVENTION

This invention relates generally to a method and an apparatus for tufting, and is more particularly concerned with a tufting machine readily adaptable for producing a wide variety of tufted fabrics.

BACKGROUND OF THE INVENTION

Various forms of tufting machines have been used for many years, the most common variety including generally a needle for penetrating a backing material to carry a yarn through the backing, and some form of looper for holding the yarn to form a loop as the needle is withdrawn. While this basic technique is extremely simple, such a simple arrangement allows no variation for defining a pattern on the face of the tufted goods. In order to define a pattern on tufted goods, the usual techniques are to use short tufts and long tufts in some predetermined sequence in order to define a pattern, and/or to use cut tufts versus uncut tufts, or loops, to define a pattern. Much effort has been expended in attempting to provide various arrangements of machines to make the high and low tufts in a tufted fabric, and especially to provide the cut and uncut tufts as the fabric is sewn.

To provide a machine for producing both cut and uncut tufts, the prior art has normally utilized either a single looper so arranged that a loop will either remain on the looper and be cut or be doffed from the looper and remain uncut, or the prior art has utilized a pair of loopers, one for forming loops and the other for cutting loops, the loops to be cut being transferred from the loop pile looper to the cut pile looper.

The prior art utilizing a single looper wherein loops are either left on the looper to be cut or doffed from the looper to remain uncut have the inherent problem of requiring a large amount of apparatus which becomes generally unreliable. When it is considered that the device for urging a loop from a looper must be multiplied many times so that there is one such device for each looper, hence for each needle on the tufting machine, it will be realized that the quantity of the apparatus is unwieldy. In the prior art devices wherein two separate loopers are utilized, the primary difficulties lie in the positive transfer of a loop from the loop pile looper to the cut pile looper when a loop is to be cut, and the careful avoidance of transfer when a loop is to remain uncut. When such transfer is handled with positive motions and positive pickup, there has usually been a large amount of movable apparatus for shifting a looper to engage a loop, and when the transfer is not handled positively, the expedient of simply shortening the uncut loops to avoid the cut pile looper has normally been used. While such an expedient is effective, it precludes the sewing of fabric having uncut loops as long as the cut loops, and especially longer than the cut loops.

SUMMARY OF THE INVENTION

The present invention overcomes the above mentioned and other difficulties with the prior art tufting machines and methods by providing a machine having at least one needle for carrying a yarn through a backing fabric, a loop pile looper adjacent to the needle for engaging the yarn and holding the yarn as the needle is withdrawn, and a cut pile looper generally aligned with the loop pile looper. The arrangement is such that the loop pile looper moves towards the cut pile looper and the cut pile looper moves towards the loop pile looper until the bills of the two loopers are adjacent to each other, the cut pile looper being somewhat above the loop pile looper. Means are provided for selectively tightening yarn carried by the loop pile looper as the loop pile looper moves away from the cut pile looper to cause the loop to transfer to the cut pile looper. In the event that the yarn is not tightened, the cut pile looper will recede from the loop and the loop will not transfer to the cut pile looper. It will therefore be seen that the loop may be cut or uncut, as determined by whether or not yarn is tightened, or tensioned, at the appropriate time. It is also a feature of the present invention that the backing material is angled upwardly immediately beyond the needles for assisting in removing a loop from the vicinity of the cut pile looper and for providing space to accommodate the mechanism required. A further feature of the present invention includes the use of a double billed cut pile looper wherein the upper bill is in the position to have the loop transferred or not, and the lower bill also passes through the loop to receive loops not transferred to the upper bill. This will result in a high/low cut pile fabric.

BRIEF DESCRIPTION OF THE DRAWINGS

These and other features and advantages of the present invention will become apparent from consideration of the following specification when taken in conjunction with the accompanying drawings in which.

Figure 6:
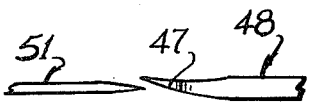
Figure 5:
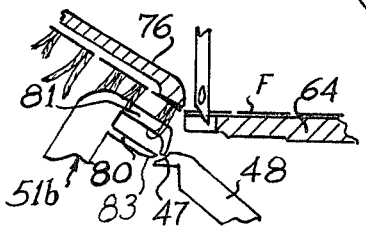
Figure 4:
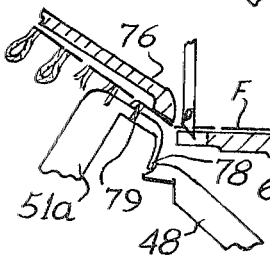
Figure 7:
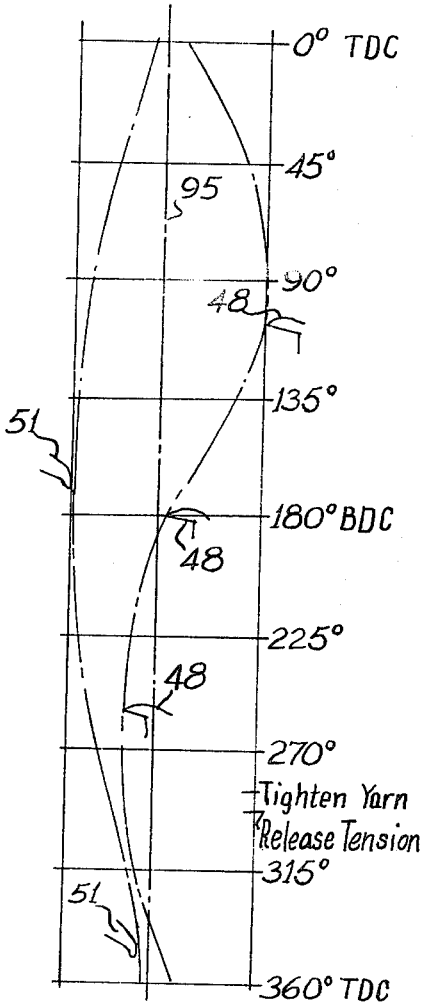

FIGS. *3a–3d* are sequential views showing the movements of the loopers for forming level, cut/loop, pile;

FIG. 4 is a view similar to FIG. *3c* but showing an arrangement for forming a high-loop-low-cut pile fabric;

FIG. 5 is a view similar to FIG. *3c* but showing the arrangement for forming a high/low cut pile fabric;

FIG. 6 is a partial top plan view showing the cut and loop-pile loopers to illustrate their alignment; and, FIG. 7 is a diagram showing the timing of the principal components of the tufting machine of the present invention.

DESCRIPTION OF THE PREFERRED EMBODIMENTS

Figure 1:
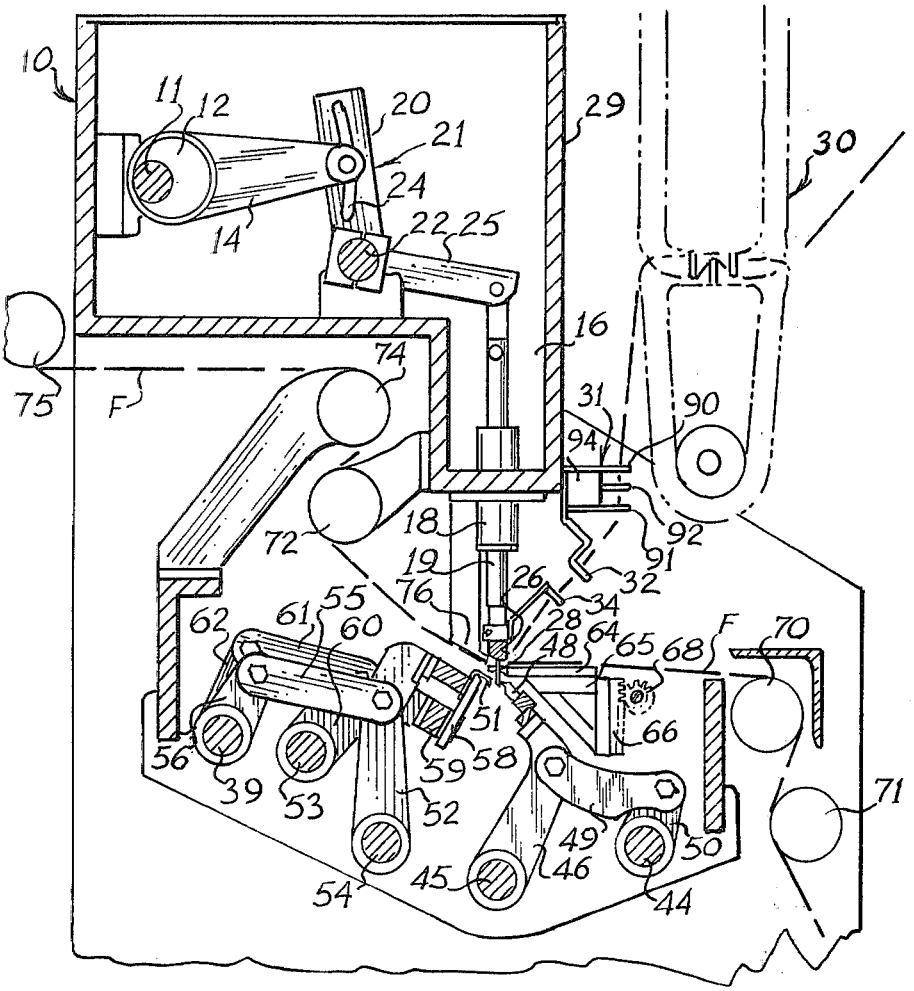
FIG. 1 is a transverse cross-sectional view through a tufting machine made in accordance with the present invention.

Referring now more particularly to the drawings, and to those embodiments of the invention here chosen by way of illustration, it will be seen that the tufting machine shown in FIG. 1 of the drawings includes a head 10 enclosing the main drive shaft 11 from which the various components of the tufting machine are driven. The main drive shaft 11 includes an eccentric 12 as is conventional in tufting machines for causing reciprocation of an arm 14. Whereas the conventional tufting machine has a head centrally located and extending longitudinally of the tufting machine, the tufting machine of the present invention includes the head 10 extending forward from the rearmost edge 15 of the machine, and having a downwardly extending portion 16 supporting the packing glands 18 which receive the needle bar carrying rods 19. With this arrangement, it will be seen that the arm 14 extends transversely of the head 10 for connection to an upstanding arm 20 of a bell crank generally designated at 21, the bell crank 21 being pivotally carried by a shaft 22.

The arm 20 of the bell crank 21 is provided with a slot 24 so that the point of attachment of the arm 14 is variable towards and away from the shaft 22. It will be readily understood that the eccentric 12 remains constant, so that a change in the point of attachment of the arm 14 to the arm 20 of the bell crank 21 will vary the angular motion of the bell crank 21. As the angular motion of the bell crank 21 varies, the arm 25 of the bell crank 21 remains constant so that the vertical motion of the shaft 19 is varied. Since the shaft 19 carries the needle bar 26, it will be seen that the stroke of the needle bar 26, hence the needle 28, will be varied.

With the arrangement of the head 10 as described above, it will be seen that the front 29 of the head 10 is only slightly forward of the needle 28. Due to this arrangement, the pattern mechanism, such as the slat pattern attachment 30, can be placed adjacent to the front 29 of the head 10, and an operator will still have easy access to the front of the machine in the vicinity of the needle bar 26.

It will also be seen in FIG. 1 of the drawings that there is a second pattern attachment generally designated at 31 which will be discussed in more detail hereinafter. From the pattern attachment 31, the yarn passes through a stationary guide 32, then through the yarn jerker 34, thence to the needle bar 26 and the needles 28. Those skilled in the art will realize that the arrangement with the yarn guide 32 and the yarn jerker 34 is conventional, and no further description is thought to be necessary.

Figure 2:
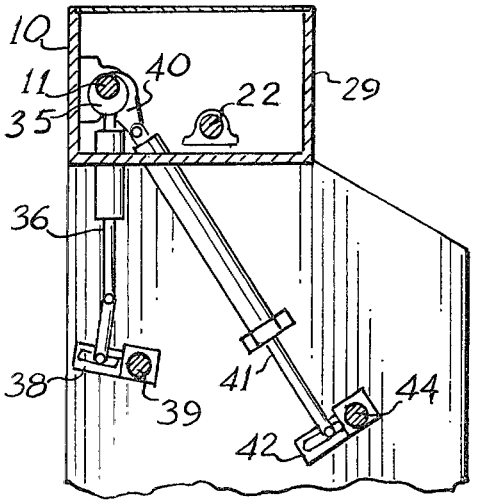
FIG. 2 is a transverse cross-sectional view through the tufting machine shown in FIG. 1, FIG. 2 being on a reduced scale and showing the drive linkages for the machine.

Looking briefly at FIG. 2 of the drawings, it will be seen that the main shaft 11 is provided with another eccentric 35 having a connecting rod 36 which is connected to a crank 38 on a shaft 39. An eccentric 40 has a connecting rod 41 which is connected to a crank 42 for oscillating a shaft 44. With this in mind, attention is again directed to FIG. 1 of the drawings where it will be seen that the shafts 39 and 44 are the drive shafts for the loopers and the knives.

In FIG. 1, it will be seen that there is a shaft 45 on which an arm 46 is pivoted, the arm 46 carrying the loop pile loopers 48 at the upper end thereof. The arm 46 is oscillated about the shaft 45 by means of a pitman 49 which is connected between the arm 46 and a crank 50, the crank 50 being carried by the shaft 44. Thus, as the connecting rod 41 reciprocates to oscillate the shaft 44, the shaft 44 causes oscillation of the crank 50 to move the pitman 49 and cause oscillation of the arm 46 about the shaft 45. This causes the loop pile looper 48 to move towards and away from the needle 28 and in a plane perpendicular to the path of the backing fabric as will be discussed in more detail hereinafter.

Facing the loop pile looper 48, and in transverse alignment therewith, there is a cut pile looper 51 which is carried by an arm 52 mounted on a shaft 54 so the cut pile looper moves in the same plane as the loop pile looper. The arm 52 has a pitman 55 pivoted thereto, and to a crank 56 on the shaft 39. Cooperating with the cut pile looper 51 there is a knife 58 which is carried by a knife block 59, the knife block 59 being carried by an arm 60. To cause appropriate movement of the arm 60, there is a pitman 61 connected to a crank 62 on the shaft 39. It will therefore be seen that, as the rod 36 reciprocates to cause oscillation of the crank 38 and the shaft 39, the shaft 39 will oscillate to cause oscillation of the cranks 56 and 62. Oscillation of these cranks will cause reciprocal motion of the pitmans 55 and 61 which will, in turn, cause oscillation of the arms 52 and 60 about their respective shafts 54 and 53. With the pivot points arranged as shown, it will be understood that, as the arms 52 and 60 move rearwardly, the knife 58 will move up relative to the looper 51 to cut any loops thereon.

It will also be seen in FIG. 1 of the drawing that the tufting machine includes a substantially conventional bed plate 64. It will be seen however that the bed plate 64 is carried by a vertically adjustable carriage 65, the carriage 65 including a rack 66 and a pinion 68 which will cooperate to move the carriage 65 up and down, thereby moving the bed plate 64 up and down. Those skilled in the art will recognize that, since the bed plate 64 locates the backing material with respect to the loopers 48 and 51, a change in the position of the bed plate 64 will cause either a longer or a shorter tuft to be sewn into the backing fabric. It will also be seen that there are feed rolls 70 and 71 located at the front of the tufting machine as is generally conventional, the backing fabric F passing around the feed rolls 70 and 71, over the bed plate 64, and under the needle bar 26. Past the needle bar 26, the backing fabric F turns upwardly and passes over rolls 72 and 74, then out to a roll 75. A presser foot 76 is provided to hold the fabric down adjacent to the needles 28; and, while the provision of a presser foot 76 is conventional, the presser foot 76 as here disclosed is novel in that the foot 76 provides for the angular disposition of the backing fabric F.

In view of the arrangement discussed, it will be understood that, from immediately behind the tufting machine, the face side of the tufted fabric will be visible, rather than the back-stitch as is conventional. This will allow an inspector to stand immediately behind the tufting machine and inspect the quality of the face of the fabric before the fabric is placed into a roll.

Figure 3A:
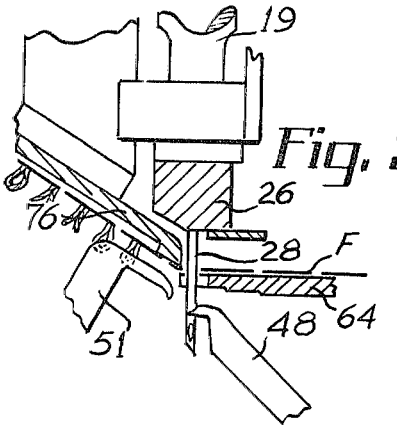
Figure 3D:
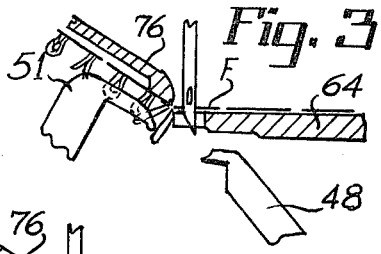
Figure 3B:
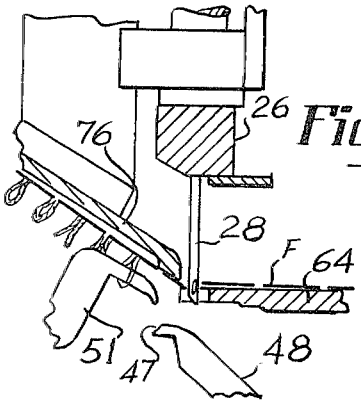

Turning now to FIGS. 3*a* through 3*d* of the drawings for an understanding of the operation of the method and apparatus of the present invention, it will be understood that the needle 28 moves down, piercing the backing fabric F, and the loop pile looper 48 begins to move forward, i.e. towards the needle 28. When the needle 28 reaches its lowermost position, the bill of the loop pile looper 48 is adjacent to the needle as shown in FIG. 3*a*, and the loop pile looper 48 continues to move forward so that the bill of the loop pile looper 48 extends between the yarn Y and the needle 28. As the needle 28 moves up, the loop pile looper moves farther forward, and the cut pile looper 51 also moves forward, as shown in FIG. 3*b*.

Attention is next directed to FIG. 6 of the drawings, to be considered in conjunction with the foregoing. In FIG. 6 it will be seen that the loop pile looper 48 is pointed as is substantially conventional, the point being arranged to enter between the needle 28 and the yarn Y carried by the needle. It should be noted, however, that the looper 48 is somewhat wider than is conventional. While this width is not mandatory in the present invention, the greater width opens a loop for easier entry by the cut pile looper 51 when the loop is to be transferred.

The cut pile looper 51, as was previously stated, is aligned with the loop pile looper 48 so the two loopers move in the same plane. As a result, when the cut pile looper 51 moves towards the loop pile looper 48, the two loopers can be so placed that a loop of yarn can be transferred from the looper 48 directly to the looper 51. Thus, the only mechanism actually to contact the cut pile looper 51 is the knife 58. In this connection it should be noted that the cut pile looper 51 is pointed in plan view to provide a sharp leading edge. This sharp leading edge facilitates the entry of the looper 51 into a loop of yarn held on the looper 48.

Figure 3C:
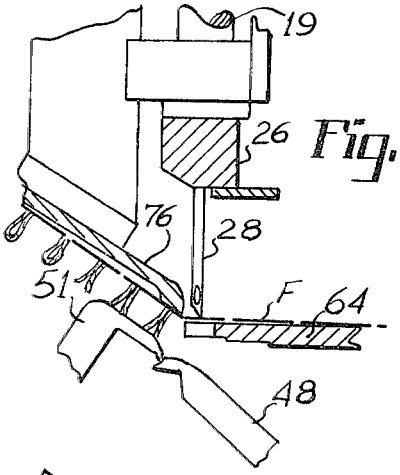

At this point, it should be understood that the bill of the loop pile looper 48 is sloped upwardly as is generally conventional in the art. This allows a loop of yarn Y to move off the bill of the loop pile looper 48 as the looper 48 moves rearwardly. The bill of the cut pile looper 51 is sloped down in the present invention, and it will be remembered that the loop pile looper 48 and the cut pile looper 51 are aligned with each other in the direction of motion of the fabric F as shown in FIG. 6. Thus, as the loop pile looper 48 begins to move backwards, and the cut pile looper 51 moves forward, the bill of the cut pile looper moves to a point immediately adjacent to the bill of the loop pile looper as is shown in FIG. 3*c*. At this point, if the loop of yarn Y is pulled tight, the loop will slip off the bill of the loop pile looper 48 and move onto the bill of the cut pile looper 51. The loop pile looper 48 moves rapidly rearwardly leaving the loop on the cut pile looper where the knife 58 will subsequently sever the loop to make a cut pile tuft, as shown in FIG. 3*d*.

It is important to note that the cut pile looper 51 and the loop pile looper are juxtaposed to allow transfer of the loop for a short period of time. To provide a long enough period of time to effect the transfer, the loop pile looper 48 has a concavity 47 on the nose thereof. The concavity 47 is of a radius such that, as the looper 48 moves back in its arcuate path, and the looper 51 moves forward in its arcuate path, the tip of the looper 51 will move into the concavity 47 to remain a substantially fixed distance from the looper 48. As long as the tip of the looper 51 is within the concavity 47, the two loopers are close enough that a loop can be transferred by tensioning the yarn as described. While the loop may be transferrable without use of the concavity 47, the point of transfer will be extremely critical and difficult to achieve repeatably.

Beginning at the same point wherein the loop pile looper 48 is beginning to move rearwardly and the cut pile looper 51 has the tip of its bill at the tip of the bill of the loop pile looper 48, if the loop of yarn Y is allowed to remain loose, the loop pile looper 48 will move rearwardly quite rapidly leaving the loop hanging free. Since the loop pile looper 48 physically carries the loop beyond the line of the needle 28, when the loop is not intentionally placed on the bill of the cut pile looper 51 and the loop pile looper 48 moves rearwardly, the loop tends to move somewhat back into line with the needle 28; then, when the backing fabric F moves forward, the loop will be moved one increment and will move to the upwardly slanted portion of the backing fabric F to be out of the way of the cut pile looper 51 so that there is no danger of having the loop caught on the cut pile looper 51.

It will therefore be seen from the above discussion that a loop pile looper and a cut pile looper are provided, the loop being initially formed on the loop pile looper; and, the loop is transferred or not to a cut pile looper, depending on whether the loop is to be cut or not, the transfer being made by tensioning the yarn when the bills of the two loopers are adjacent.

Looking now at FIG. 4 of the drawings, it will be seen that the arrangement is very similar to that shown in FIG. 3*c* except for the configuration of the cut pile looper 51, the cut pile looper being here designated as 51*a*. The loop pile looper 48 is formed precisely the same as that discussed in connection with FIG. 3, and the tip 78 of the bill of the looper 51*a* is positioned in the concavity 47 as discussed in connection with FIG. 3*c*. The difference in the looper 51*a* is that the throat is deeper, placing the throat 79 closer to the backing material F while the distance of the bill of the looper 48 from the fabric F remains the same. It should therefore be understood that loops will be formed by the loop pile looper 48; and, if the loops are not transferred to the cut pile looper 51*a*, the loops will be substantially as long as formed. On the other hand, if the loop is formed on the loop pile looper 48 and is transferred to the cut pile looper 51*a* by briefly tensioning the yarn at the appropriate time, the loop will be tightened to form a short loop on the looper 51*a*, which will subsequently be cut by the knife 58. As a result, it will be seen that the fabric made by the arrangement shown in FIG. 4 of the drawings will be a high loop pile in conjunction with a low cut pile.

Those skilled in the art will realize that the pattern mechanism 30 feeds the amount of yarn required for a stitch in accordance with the particular pattern, and each stitch is tightened by the yarn jerker 34. This causes a tension on the yarn, and this tension can be used to cause the transfer of a loop as described above. Therefore, when a high-loop-low-cut pile fabric is to be provided, the pattern mechanism 31 is not required, and the slat or other conventional pattern mechanism 30 can be used alone.

Looking at FIG. 5 of the drawings, it will be seen that there is yet another configuration of the cut pile looper, the cut pile looper in FIG. 5 being designated as 51*b*. The cut pile looper 51*b* has two bills 80 and 81, the bill 81 being arranged substantially the same as the bill of the looper 51*a* in FIG. 4. As a result, it will be understood that a loop will be formed by the loop pile looper 48; and, with tension on the yarn at the appropriate time, the loop will be transferred to the bill 81 of the looper 51*b*, and a low cut pile will be formed.

It will be observed that the lower bill 80 of the looper 51*b* has its outer end curved up: somewhat the reverse of a conventional looper. Considering the arrangement shown in FIG. 5, it will be understood that, when a loop is tensioned, it must pass off the end of the loop pile looper 48, between the end 83 of the bill 80 and the concavity 47 of the looper 48. Thus, the upwardly rounded end 83 provides necessary clearance for the loop of yarn to avoid the bill 80 of the looper 51*b* and to be transferred to the bill 81 of the looper 51*b* when the yarn is appropriately tensioned.

It should also be realized that the loop formed on the loop pile looper 48 will be tightened by the yarn jerker to form a short tuft in accordance with the amount of yarn fed by the pattern mechanism such as the slat pattern mechanism 30. The tension provided in this tightening of the stitch can also provide for the transfer of a loop as previously discussed, so a pattern mechanism such as the mechanism 31 is not required.

With the above in mind, when a long tuft is to be provided, the pattern mechanism 30 will feed enough yarn for the desired length of tuft. Then, when the yarn jerker tightens the stitch to the final length, there will not be enough tension on the yarn to cause transfer to the upper bill 81. Therefore, as the loop pile looper 48 and the cut pile looper 51*b* approach each other, both the upper bill 81 and the lower bill 80 of the looper 51*b* will enter the loop. As the loop pile looper 48 moves back, the cut pile looper 51*b* continues to move forward; so, since the cut pile looper 51*b* is already holding the loop somewhat, the loop is not transferred to the upper bill 81, and the cut pile looper 51*b* moves further forward, it will be seen that the loop will remain on the lower bill 80 of the looper 51*b* and become a long tuft.

It will of course be understood that, whether the loop is on the bill 80 or the bill 81, the cooperating knife such as the knife 58 will sever the loops to form cut tufts.

With the above in mind, attention is again directed to FIG. 1 of the drawings and to the pattern mechanism 31. It will be remembered, as discussed in connection with FIG. 3 of the drawings, that the transfer of a loop from the loop pile looper to the cut pile looper is caused by a tightening of the yarn Y at the appropriate time. Though numerous means may be devised for the appropriate tightening, one simple expedient is shown in FIG. 1 wherein the yarn Y passes through appropriate holes in a pair of plates 90 and 91 to provide stationary yarn guides. Between these plates, or guides, there is a movable member 92 which also receives the yarn Y through an appropriate opening therein. The movable member 92 is carried by a solenoid 94 or other such device for causing the movable member 92 to move reciprocally. It will therefore be seen that, if the device 92 is moved outwardly the yarn Y will be required to take a longer path which will cause additional tension in the yarn Y. As a result, when the yarn is to be tensioned to cause transfer from the looper 48 to the looper 51, the solenoid 94 can be briefly energized by an appropriate pattern mechanism. While no pattern mechanism is here shown, those skilled in the art will realize that there are numerous prior art devices that can be adapted to energize an electric solenoid briefly, or to provide appropriate pressures in the case of pneumatic devices or the like.

One important feature of this arrangement is that the pattern mechanism 31 can act almost instantaneously, in any part of the machine cycle. Since only the momentary closing and opening of a switch or the like is required to project and retract the member 92, the pattern mechanism 31 need not be timed with the tufting machine in the usual fashion. This allows the yarn to be tensioned at the precise point desired for the transfer of a loop from the looper 48 to the looper 51, and relaxed almost immediately thereafter.

While the pattern mechanism 31 is especially desirable when sewing a level cut/loop pile fabric, when a high/low pile fabric is to be sewn, a more conventional pattern mechanism may be useful due to the requirement for feeding the appropriate amounts of yarn for the pattern desired. The pattern mechanism generally designated at 30 is here shown somewhat schematically since it is a conventional slat type pattern mechanism well known to those skilled in the art. Nevertheless, the pattern mechanism 30 can be used to feed the right amounts of yarn for each stitch, so the yarn jerker will provide tension necessary in transferring a loop from the looper 48 to the looper 51*a* or 51*b* without use of a device such as the pattern mechanism 31 when the fabric is not level pile fabric.

Attention is next directed to FIG. 7 of the drawings which shows one full cycle of the machine in order to illustrate the timing. The centerline 95 represents the line of the point of the needle, and the two somewhat sinusoidal curves represent the motions of the loopers 48 and 51 from 0° to 360° rotation of the main shaft 11. Looking at the top of FIG. 7, it will be seen that, at 0° the needle is at its top dead center. As the shaft rotates and the needle starts down, both the cut pile looper 51 and the loop pile looper 48 move rearwardly. At 105° rotation, the loop pile looper 48 is at its rearmost position and begins to move forward. As the shaft continues to rotate, at approximately 168° the cut pile looper 51 is at its rearmost position and begins to move forward.

In the vicinity of 180°, when the needle is at its bottom dead center, the tip of the loop pile looper 48 passes the centerline of the needle where it will pick up the yarn passing through the eye of the needle. The looper 48 picks up the yarn, and the needle 28 begins to rise while the loop pile looper 48 continues to move forward. It will be observed that the loop pile looper 48 moves a substantial distance beyond the centerline of the needle, then the loop pile looper 48 begins to move rearwardly. Shortly after the rearward motion of the looper 48 begins, the cut pile looper 51 is substantially immediately adjacent to the loop pile looper so that, in the vicinity of 280° the yarn would be tightened if the loop is to be transferred to the cut pile looper 51, and tension would be relaxed around 295° to 300°. After this, the loop pile looper 48 moves rearwardly rather fast, the cut pile looper 51 reaches its forwardmost position at approximately 348°, and it begins to move rearwardly.

Further concerning the tensioning of the yarn to effect a transfer of a loop, the tensioning would be timed around 280° when a pattern mechanism such as the mechanism 31 is used, this apparatus providing a sudden tensioning and a sudden release of the tension. Those skilled in the art will realize that, in using a pattern mechanism such as the pattern mechanism 30, the tension is increased gradually. Thus, if the tension to effect the transfer is provided by the pattern mechanism 30, the timing would be set so the maximum tension occurs around 280°.

One important thing to note from FIG. 7 of the drawings is that the loop pile looper 48 travels a great distance, this distance in one successful embodiment of the invention being approximately 11/16 inch. On the other hand, the cut pile looper 51 moves a very small distance, in the vicinity of 5/32 inch total travel. It is therefore the great distance traveled by the loop pile looper that delivers the loop to the vicinity of the cut pile looper for possible transfer. Due to this arrangement, if the yarn is not tightened to transfer the loop to the cut pile looper 51, the loop pile looper will move rearwardly, leaving the loop hanging freely and the cut pile looper 51 cannot pick up the loop.

From the foregoing, it should now be understood that the tufting machine of the present invention can be arranged to sew almost any conceivable combination of tufts on fabric. If a level loop pile is desired, the cut pile looper 51 would not be required, and the conventional pattern mechanism 30 in conjunction with the loop pile looper 48 will provide the level loop pile fabric, the pattern mechanism 30 having no notches cut in the slats so the yarn feed is at a constant rate. If a high/low loop pile is desired, the same arrangement would be used but the slats of the pattern mechanism 30 would be notched to feed varying amounts of yarn.

For a level cut pile, the arrangement shown in FIG. 3 of the drawings would be used with a pattern mechanism such as the pattern mechanism 31, and the yarns would be tensioned to transfer every stitch. For a high/low cut pile, the double billed loopers 51*b* as shown in FIG. 5 would be used in conjunction with the pattern mechanism 30, the slats being notched to feed the desired varying amounts of yarn. If a high-loop-low-cut pile is desired, the arrangement shown in FIG. 4 of the drawings can be provided, the only requirements being installation of the cut pile loopers 51*a* and use of a pattern mechanism 30 with slats appropriately notched.

If a level cut/loop pile is desired, the arrangement shown in FIG. 3 would be used, and a pattern mechanism such as the pattern mechanism 31 can be utilized for tensioning the yarns for the appropriate transfer. Also utilizing an arrangement as shown in FIG. 3 of the drawings, if a high-cut-low-loop pile is desired, the transfer mechanism as discussed in conjunction with FIG. 3 can be use to provide the cut pile tufts, and the loop can be provided as discussed using a pattern mechanism such as the pattern mechanism 30 with notched slats. It will also be understood that it would be possible to mount various forms of cut pile loopers 51, 51*a* and 51*b* across the width of the machine simultaneously if desired since the strokes of the various loopers would remain the same and only the looper itself and the pattern mechanism would be changed.

It will therefore be seen that the variety of patterns obtainable with the present machine is limited only by the imagination of the user of the machine.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as defined in the appended claims.

I claim:

1. A tufting machine, including at least one needle for successively carrying a yarn through a backing fabric as said backing fabric moves along a path, and a looper successively engageable with said yarn to form a plurality of loops as said needle is withdrawn from said backing fabric, the improvement wherein said looper is a loop pile looper movable in a plane, said plane being perpendicular to said path of said backing fabric and parallel to a line drawn through said plurality of loops, and further including a cut pile looper aligned with said loop pile looper in the direction of motion of said backing fabric and movable in said plane, the arrangement being such that said plane passes through the centerline of both said loop pile looper and said cut pile looper, means for moving said loop pile looper and said cut pile looper towards each other to be adjacent to each other while one loop of said plurality of loops is on said loop pile looper, means for selectively tightening said yarn for causing selective transfer of said one loop from said loop pile looper to said cut pile looper, and means for severing loops while on said cut pile looper.

2. A tufting machine as claimed in claim 1, said loop pile looper having a bill thereon for engaging said loop, said cut pile looper having a bill thereon for engaging said loop, said bill on said cut pile looper being sloped down for receiving said loop from said bill of said loop pile looper, said bill of said cut pile looper being oriented so that the tip of said bill of said cut pile looper is adjacent to the tip of the bill of said loop pile looper.

3. A tufting machine as claimed in claim 2, said cut pile looper having a throat portion for cooperating with said means for severing said loop, said throat portion being closer to said backing fabric than said tip of said bill of said cut pile looper.

4. A tufting machine as claimed in claim 2, said bill of said cut pile looper being an upper bill, said cut pile looper further including a lower bill co-planar with said upper bill, said lower bill extending into said loop for receiving said loop when not transferred to said upper bill.

5. A tufting machine a claimed in claim 2, said loop pile looper defining a concavity on said bill for receiving said bill of said cut pile looper.

6. A tufting machine as claimed in claim 5, said bill of said cut pile looper defining a sharp leading edge for entering said loop.

7. A method for making a tufted fabric wherein a yarn is extended through a backing fabric at successive intervals to form a series of tufts on the face of the backing fabric as said backing fabric moves along a path, said method including the steps of extending a needle through said backing fabric to carry said yarn through said backing fabric, passing a first looper adjacent to said needle to engage said yarn, said first looper moving in a plane, said plane being perpendicular to said path of said backing fabric and parallel to a line drawn through said series of tufts, removing said needle while holding said yarn on said first looper to form a loop, moving a second looper and said first looper towards each other while said first looper holds said loop to place said first looper and said second looper immediately adjacent to each other and aligned in the direction of motion of said backing fabric, said second looper moving in said plane such that said plane passes through the centerline of both said first looper and said second looper, and selectively tightening said yarn while moving said first looper rearwardly to selectively transfer said loop to said second looper.

8. A method as claimed in claim 7, and further including the step of placing the bill of said second looper generally above said first looper during the step of tightening the yarn to transfer said loop to said second looper.

9. A method as claimed in claim 8, said second looper being a cut pile looper having a throat a first distance from said backing fabric, said first looper being a loop pile looper having a throat a second distance from said backing fabric, said method further including the step of severing said loop on said second looper.

10. A method as claimed in claim 9, said second looper having a lower bill and an upper bill, said upper bill receiving said loop when said yarn is tightened, said method further including the step of passing said lower bill through said loop as said first looper and said second looper are moved towards each other, said lower bill retaining said loop when said yarn remains loose.

11. A method as claimed in claim 9, said first distance being less than said second distance.

12. A method as claimed in claim 10, said upper bill having a throat said first distance from said backing fabric, said lower bill having a throat a third distance from said backing fabric, said second distance and said third distance being substantially equal, and said first distance being less than said second distance.

13. A method as claimed in claim 7, and further including the steps of feeding sufficient yarn to cause said loop to remain slack and not transfer to said second looper, advancing said backing fabric, and bending said backing fabric upwardly to aid said loop in avoiding said second looper.

14. A method as claimed in claim 7, and further including the step of maintaining a substantially fixed distance between said first looper and said second looper while said first looper is moving rearwardly to allow time to transfer said loop.

15. A tufting machine, comprising a head, a bed plate generally parallel to and beneath said head, a needle bar generally parallel to said bed plate, a plurality of shafts carrying said needle bar, said plurality of shafts carrying said needle bar being reciprocally carried from said head, a plurality of needles extending downwardly from said needle bar and being reciprocable from a position wherein the eyes of said needles are above said bed plate to a bottom position wherein the eyes of said needles are below said bed plate, feed rolls for feeding a backing fabric over said bed plate, a presser foot for holding said backing fabric and defining a path through said tufting machine, said path angling upwardly at said presser foot, guide rolls for causing said backing to follow said path, a first plurality of loopers beneath said bed plate, each looper of said first plurality of loopers being associated with one needle of said plurality of needles and being movable in a plane, said plane being perpendicular to said bed plate, a second plurality of loopers, each looper of said second plurality of loopers being aligned with one looper of said first plurality of loopers and movable in said plane, said second plurality of loopers being beneath said path angling upwardly, the arrangement being such that said needles insert yarns through said backing fabric, said yarns are engaged by said first plurality of loopers to form loops, and said backing fabric is angled upwardly to shift said loops with respect to said first plurality of loopers and assist in avoiding said second plurality of loopers.

16. A tufting machine as claimed in claim 15, said second plurality of loopers being angularly disposed such that the bills of said second plurality of loopers slope downwardly and are generally parallel to said backing fabric when said backing fabric angles upwardly.

17. A tufting machine as claimed in claim 16, and including looper drive means for moving said first plurality of loopers and said second plurality of loopers towards each other to be immediately adjacent to each other, and pattern means for selectively tensioning said yarn for causing transfer of selected loops from said first plurality of loopers to said second plurality of loopers.

18. A tufting machine as claimed in claim 17, said pattern means comprising spaced yarn holding means, and movable yarn guide means therebetween for deflecting said yarn between said yarn holding means.

* * * * *